US010174501B1

(12) United States Patent
Underkofler et al.

(10) Patent No.: US 10,174,501 B1
(45) Date of Patent: Jan. 8, 2019

(54) METAL BAFFLES

(71) Applicant: USG Interiors, LLC, Chicago, IL (US)

(72) Inventors: Abraham M. Underkofler, Salem, WI (US); Peder J. Gulbrandsen, Aurora, IL (US); Mark R. Paulsen, Waukegan, IL (US); Kyle S. Carolus, Guelph (CA)

(73) Assignee: USG INTERIORS, LLC, Chicago, IL (US)

( * ) Notice: Subject to any disclaimer, the term of this patent is extended or adjusted under 35 U.S.C. 154(b) by 0 days.

(21) Appl. No.: 15/696,597

(22) Filed: Sep. 6, 2017

(51) Int. Cl.
*E04B 9/18* (2006.01)

(52) U.S. Cl.
CPC ..... *E04B 9/183* (2013.01)

(58) Field of Classification Search
CPC ..... E04B 9/363; E04B 1/86; E04B 1/8409; E04B 1/99; E04B 9/10; E04B 9/18; E04B 1/8209; E04B 2001/8263; E04B 1/994; E04B 2001/8272; E04B 9/183
See application file for complete search history.

(56) References Cited

U.S. PATENT DOCUMENTS 2,909,355 A * 10/1959 Nelson ..... E04B 9/18 110/111
2,994,113 A * 8/1961 Dail ..... E04B 9/16 52/506.08
3,211,403 A * 10/1965 Havener ..... E04B 9/18 248/62
3,436,047 A * 4/1969 Foltz ..... A47H 1/104 104/111
3,596,425 A * 8/1971 Kodaras ..... E04B 9/008 403/201
3,602,473 A * 8/1971 Van Riet ..... E04B 9/183 248/317
3,649,741 A * 3/1972 Fremont ..... H01R 25/14 174/491
3,784,144 A * 1/1974 Ollinger ..... F16B 5/06 248/317
4,031,664 A * 6/1977 Wendt ..... E04B 1/6116 248/300
4,041,668 A * 8/1977 Jahn ..... E04B 9/16 52/506.09
4,081,931 A * 4/1978 Miyoshi ..... E04B 9/366 52/39
4,197,923 A * 4/1980 Harris ..... E04B 1/86 181/287
4,200,171 A * 4/1980 Seymour ..... E04B 1/86 16/87 R
4,227,355 A * 10/1980 Wendt ..... E04B 1/86 160/196.1
4,485,605 A * 12/1984 LaLonde ..... E04B 9/064 52/506.06

(Continued)

FOREIGN PATENT DOCUMENTS

DE 102014001543 A1 * 9/2015 ..... E04B 9/10
EP 1927704 A2 * 6/2008 ..... E04B 9/183

(Continued)

*Primary Examiner* — Rodney Mintz
(74) *Attorney, Agent, or Firm* — Pearne & Gordon LLP

(57) ABSTRACT

Clips that engage with special top flanges on elongated U-shaped acoustical baffles. One clip form suspends the baffles from grid tees in horizontal or inclined orientations or from cables or rods. Another clip form aligns to and joins intersecting baffles.

7 Claims, 3 Drawing Sheets

(56) References Cited

U.S. PATENT DOCUMENTS 4,540,847 A * 9/1985 Gardner ..... E04B 9/064 174/491
4,544,119 A * 10/1985 Kellett ..... E04B 9/18 24/295
4,678,487 A * 7/1987 Cadwell, Jr. ..... E04B 9/02 52/506.06
4,703,598 A * 11/1987 Wilson ..... E04B 2/7409 52/204.591
4,827,687 A * 5/1989 Frawley ..... E04B 9/10 52/473
5,115,611 A * 5/1992 Lim ..... E04B 9/36 52/222
5,355,646 A * 10/1994 Bischel ..... E04B 9/16 24/563
5,577,699 A * 11/1996 Gardner ..... A47F 5/0006 248/217.2
5,768,843 A * 6/1998 Dziedzic ..... E04B 9/18 248/228.7
5,806,823 A * 9/1998 Callas ..... G09F 15/025 248/317
6,298,623 B1 * 10/2001 Wendt ..... E04B 9/006 248/343
6,317,915 B1 * 11/2001 Grearson ..... E04B 9/001 14/73
6,511,522 B1 * 1/2003 Gomez ..... E04B 9/02 454/187
7,162,837 B1 * 1/2007 Roth ..... E04B 9/183 52/120
7,624,549 B2 * 12/2009 Kopish ..... E04B 2/82 52/242
8,336,843 B2 * 12/2012 Gulbrandsen ..... E04B 9/065 24/536
8,397,408 B2 * 3/2013 Stancer, III ..... G09F 1/103 40/607.14
8,485,835 B2 * 7/2013 Liang ..... E04B 9/068 439/110
8,695,296 B2 * 4/2014 Bergman ..... E04B 9/366 52/243.1
8,713,869 B1 * 5/2014 Eychaner ..... H05K 7/20745 52/238.1
9,644,652 B2 * 5/2017 Hertweck ..... E04B 9/10
9,771,718 B1 * 9/2017 Curtin ..... E04B 9/067
9,920,525 B1 * 3/2018 Underkofler ..... E04B 9/363
9,976,303 B2 * 5/2018 Gloftis ..... E04B 9/183
10,060,460 B1 * 8/2018 Winn ..... F16B 7/0473
2005/0226683 A1 * 10/2005 Herb ..... E04B 9/127 403/230
2009/0049766 A1 * 2/2009 Kopish ..... E04B 2/82 52/167.1
2010/0043330 A1 * 2/2010 Svensson ..... E04B 9/14 52/506.08
2010/0130055 A1 * 5/2010 Liang ..... E04B 9/068 439/532
2010/0205841 A1 * 8/2010 Stancer, III ..... G09F 1/103 40/607.14
2011/0011023 A1 * 1/2011 Gulbrandsen ..... E04B 9/065 52/506.07
2012/0291397 A1 * 11/2012 Bergman ..... E04B 9/366 52/745.21
2013/0047541 A1 * 2/2013 Mayer ..... E04B 9/366 52/506.05
2013/0205702 A1 * 8/2013 D'Alessandro ..... E04B 9/183 52/506.08
2013/0227907 A1 * 9/2013 Gulbrandsen ..... E04B 9/10 52/665
2014/0112711 A1 * 4/2014 Hertweck ..... E04B 9/10 403/297
2016/0201323 A1 * 7/2016 Huwer ..... E04B 9/10 403/292
2017/0044767 A1 * 2/2017 Gloftis ..... E04B 9/183

FOREIGN PATENT DOCUMENTS

EP 2803779 A1 * 11/2014 ..... E04B 9/183
GB 2531482 A * 4/2016 ..... E04B 1/8409
KR 101709748 B1 * 2/2017

* cited by examiner

METAL BAFFLES

BACKGROUND OF THE INVENTION

The invention relates to acoustical baffles and for clips for suspending the baffles.

PRIOR ART

Acoustical baffles are used to absorb noise in enclosed occupied spaces. A common type of baffle is fabricated from sheet metal formed into an elongated panel or shaft of U-shaped cross-section. The sheet metal can be perforated to improve sound absorption and sound absorbing material can be positioned in the interior of the baffle. Acoustical baffles have been suspended on conventional suspended ceiling grid in so-called "open plenum" spaces and have been suspended directly from cables.

There is a need for systems and componentry that afford strong suspended assemblies capable of resisting wind loads or other disturbances without a need for separate fasteners. Suspension clip components should be inexpensive to manufacture and allow for baffle suspension from planar, inclined or curved ceiling grid as well as directly from overhead vertical cable.

SUMMARY OF THE INVENTION

The invention provides a baffle geometry and complementary suspension clip that achieves high separation force resistance without supplemental fasteners. The disclosed clip can be arranged to attach to ceiling grid in transverse or other orientations and can be arranged on inclined or vertically curved grid runners while allowing the baffle to hang in a vertical orientation. Additionally, the clip can be carried directly on vertical suspension cable or wire.

The disclosed baffle is characterized by mounting flanges that interlock with complementary slots on the suspension clip. The geometries of the baffle flanges and clip slots are highly resistant to separation when the baffle is subjected to lateral forces.

The disclosed clip in one arrangement is assembled with a grid tee connector preferably with a pivot joint for transverse or parallel relation between the baffle and supporting grid tee. The connector has a low profile that allows the baffle and clip to be used in installations where the supporting grid tees also carry ceiling tile. In another arrangement, the baffle clip and grid tee connections are joined with an intermediate horizontal pin joint that with two other pivot joints gives the clip three degrees of freedom, enabling the clip to connect with an inclined grid member while allowing the baffle to hang in a vertical orientation.

DESCRIPTION OF THE PREFERRED EMBODIMENT

Figure 1:
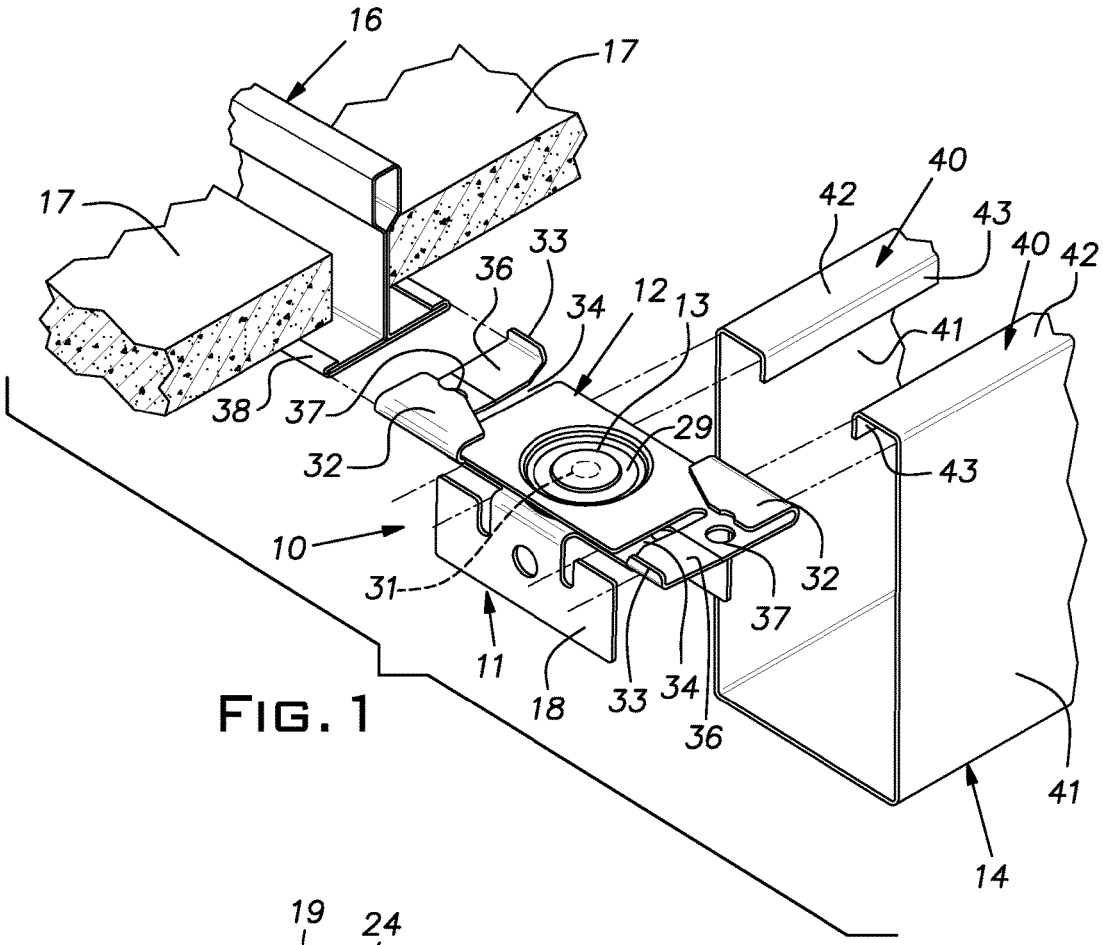
FIG. 1 is an exploded perspective diagrammatic view of a ceiling grid, ceiling tile, acoustical baffle and a clip assembly of the invention.

In the foreground of FIG. 1 is shown a sheet metal clip assembly 10 comprising a unitary baffle support clip or part 11 and a unitary grid tee engaging clip or part 12. The parts 11 and 12 are pivotally joined together by a metal rivet 13. A portion of an acoustical baffle 14 is shown in the background at the right in FIG. 1. Portions of a grid tee 16 and ceiling tile 17 supported on the grid tee are shown in the background on the left in FIG. 1.

Figure 2:
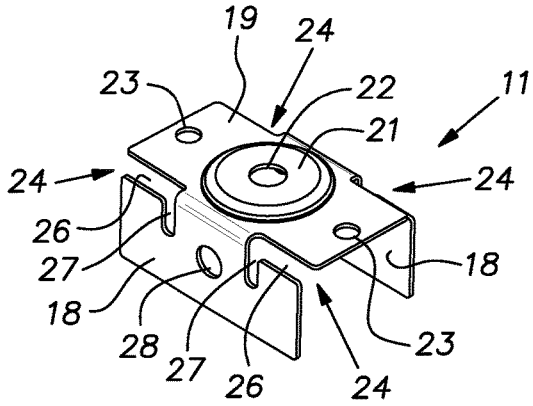
FIG. 2 is a perspective view of a clip element of the invention used in the clip assembly of FIG. 1 and in other arrangements.

FIG. 2 illustrates the baffle suspending clip part 11 which has an inverted U-shape with depending parallel legs or flanges 18 and a central rectangular web 19. The web 19 has a central circular raised embossment 21 with a central hole 22. Small holes 23 for fastening screws are stamped in adjacent ends of the web 19. At tops of the ends of both legs 18 are stamped L-shaped slots 24. Each of the four slots 24 have a horizontal portion 26 open to the end of the clip and a blind vertical portion 27 extending downwardly from the horizontal portion. The web 19, at each end of the clip 11 extends over a space defined by an imaginary projection of opposed slots 24. Holes 28 in the legs 18 can be used to suspend cables, tie straps or the like.

The unitary grid tee clip part 12 has a generally rectangular profile in plan view. A centered circular embossed depression 29 has a central hole 31. Ends of the clip 12 are diagonally symmetrical with a bent over tab 32 at one edge and a short bent up tab 33 on an opposite edge. A slot 34 is cut in the body of the clip 12 to form a cantilevered spring arm 36 on each end of the clip 12. Each arm 36 extends from adjacent a free end of the bent over tab 32 and resiliently supports the bent up tab 33 in the illustrated position. Fastener receiving holes 37 are formed adjacent a base of each spring arm 36. Heads of fasteners, such as self-tapping sheet metal screws located in the holes 37 have sufficient clearance provided by the embossments 27, 21 to allow the parts to pivot relative to one another.

The clip assembly 10 can be installed on a conventional grid tee 12 by initially misaligning it counter-clockwise looking down relative to the grid tee so that the grid tee flange passes between the bent over tabs 32 when the assembly is raised against a flange 38 of the tee 16. The spring arms 36 and tabs 33 are temporarily deflected downwardly relative to the clip proper as the clip is pushed up against the flange 38. The clip 12 is then rotated clockwise so that the bent over tabs 32 grip the top of the flange 38 and the bent up tabs 33 snap up at the edge of the flange to thereby lock the clip 12 on the grid tee 16. In severe service applications, the clip 12 can be fixed to the grid tee 16 by driving self-tapping screw fasteners through the holes 37 into the flange 38.

The bent over tabs 32 and the bent up tabs 33 have low profiles and do not extend appreciably above the grid tee flange 38. This is a benefit when ceiling tiles 17 are used in combination with the baffles 14. A bent over tab 32 lies flat against the top side of the flange 38 so that it only raises a ceiling tile locally above the flange a distance essentially equal to the thickness of the sheet metal from which it is made.

The acoustical baffle 14 of the invention is typically roll formed or press brake formed from an elongated strip of sheet metal into a U-shaped cross-section. The illustrated cross-section is rectangular but other U-shaped forms, such as V-shapes and rounded shapes are contemplated. By way of example the baffle can be 1½ inch wide and 4 inch or 6 inch deep with a length of 12, 10, 8, 6, 4, and 2 feet. Upstanding or vertical walls 41 of the baffle 14 are characterized by inturned flanges 40 having a horizontal part 42 extending from a wall 41 and a depending vertical part 43 extending downwardly from the respective horizontal part and terminating at a longitudinal edge of the sheet material from which a baffle 14 is made.

The baffle flanges 40 are proportioned to slide endwise through the clip slots 24. A strong connection between the clip 11 and a baffle 14 is formed when the flanges 38 are received in both sets of the clip slots 24. The connection is highly resistant to lateral forces on the baffle 14 because the vertical flange parts 43 resist lateral pull out by engagement with the vertical portions 27 of the slots 24 and the web 19 of the clip 11 restrains the horizontal part 42 of the baffle flange 40 against upward movement.

Where the grid tee engaging part 12 is rotated 90 degrees relative to the baffle support part 11 from the position illustrated in FIG. 1, self-tapping screws can be driven through the preformed holes 23 into the baffle horizontal flange parts 42 to augment the strength of the connection between the clip 11 and baffle 14.

In the view of FIG. 1 the baffle 14 is transverse to the grid tee 16. The baffle 14 can be supported in parallel relation to the grid tee 16 when the grid tee clip 12 is rotated 90 degrees relative to the baffle supporting part or clip 11. Moreover, the clip 11 can be oriented at other angles, enabling the baffle 14 to be supported diagonally relative to a grid tee 16.

Figure 3:
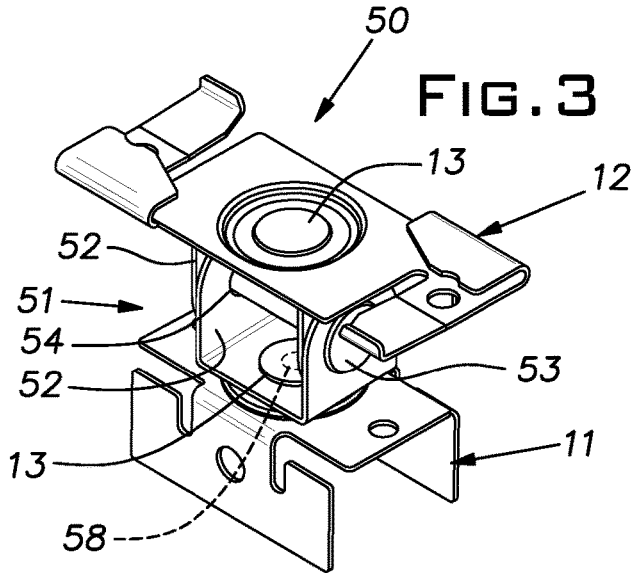
FIG. 3 is a perspective view of a clip assembly of the invention having three axes of freedom.
Figure 4:
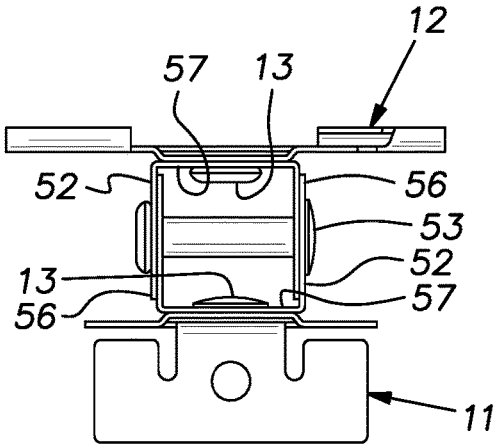
FIG. 4 is an elevational view of the clip of FIG. 3.

FIGS. 3 and 4 illustrate a modified form of clip assembly 50. The baffle support clip 11 and grid tee engaging clip 12 are structurally and functionally identical to those described above as they interact with a baffle and grid tee. The clip assembly 50 affords two additional axes of freedom obtained by a pivot joint 51 interposed between the parts 11, 12. The pivot joint 51 is made by a pair of preferably identical U-shaped sheet metal brackets 52 pivotally joined by a rivet 53. The rivet 53 is assembled through holes 54 in each bracket leg 56. Webs 57 have holes 58 for receiving associated rivets 13 assembled through respective holes in the baffle support clip 11 and grid tee engaging clip 12. The rivets are set loose enough to allow relative pivotal movement of the parts in which they are assembled. The center axis of the rivet or pin 53 is perpendicular to the center axes of the other rivets 13.

Figure 5:
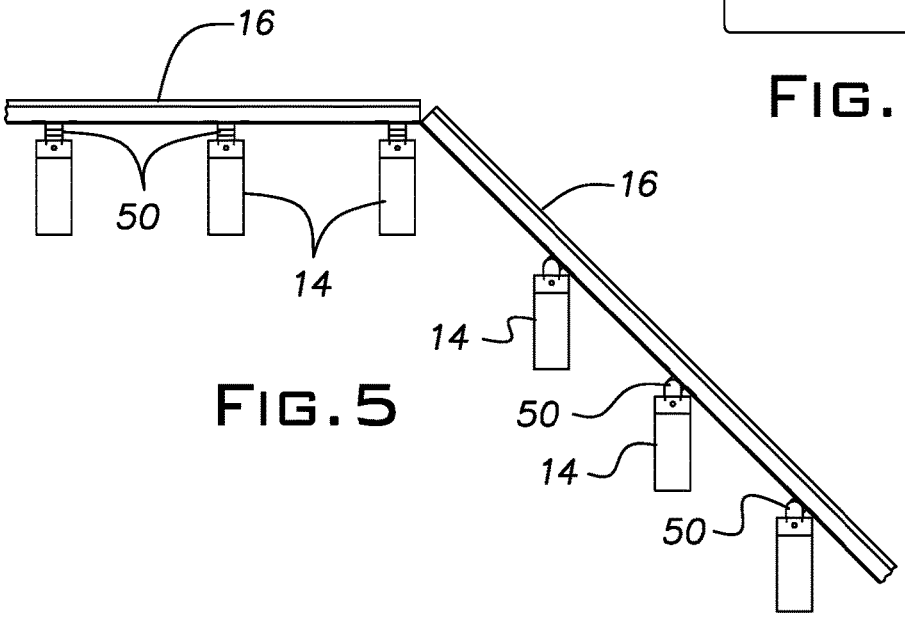
FIG. 5 is a diagrammatic view of a baffle arrangement in which the clip of FIG. 3 is used.

The clip assembly 50, for example, allows a baffle 14 to be suspended in a vertical orientation from an inclined grid tee 16 as shown in FIG. 5 or a grid tee that is curved in a vertical plane where the baffle 14 is transverse to the grid tee.

The baffle support clip 11 and a baffle 14 with which it is assembled can be suspended directly by a cable or rod having an end fitting and threaded through the central hole 22.

Figure 6:
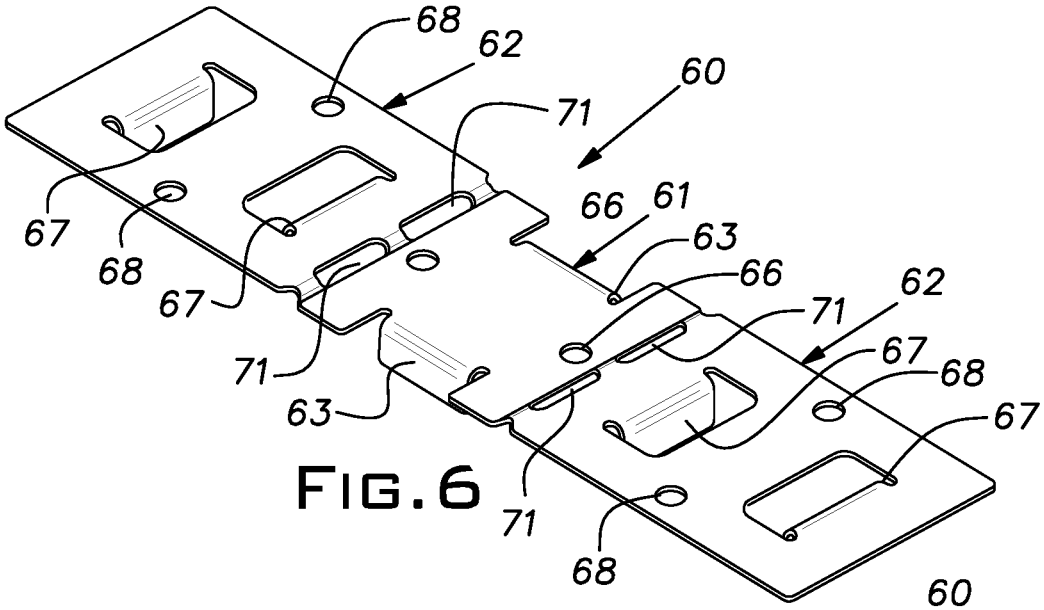
FIG. 6 is a perspective view of a clip of the invention for joining intersecting baffles.
Figure 7:
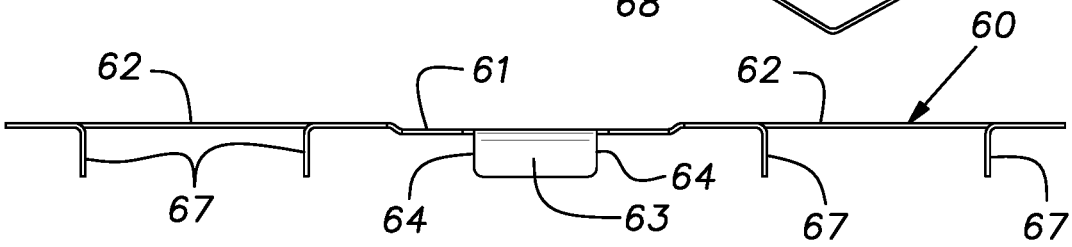
FIG. 7 is an edge view of a long side of the clip of FIG. 6.
Figure 8:
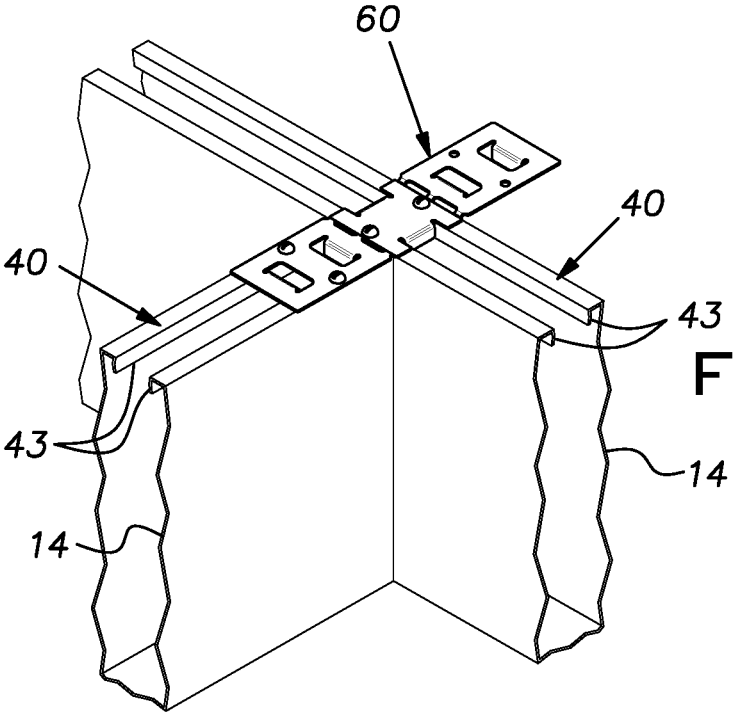
FIG. 8 is a perspective view of intersecting baffles joined by the clip of FIG. 6.

FIGS. 6, 7 and 8 illustrate a stamped sheet metal clip 60 useful for joining intersecting baffles 14 of the disclosed type. The clip 60 has an elongated rectangular profile in plan view with a width slightly narrower than the width of a baffle and a length exceeding three times its width. The clip 60 is symmetrical about its mid-length having a center section 61 and end sections 62 on opposite edges of the center section. The center section 61 has a pair of depending tabs 63. The tabs 63 are in planes parallel to the lengthwise direction of the clip 60 and are aligned with each other on a line transverse to the length of the clip. Vertical edges 64 on each tab 63 are spaced to provide a close fit with opposed vertical flange parts 43 of a baffle 14. The two tabs 63 when positioned in the top of a baffle 14 make the clip 60 self-aligning to the baffle in a direction transverse to the baffle. Holes 66 are located to overlie the horizontal flange parts 42 and receive self-tapping screws driven into the flange to securely fix the clip 60 to the transverse baffle 14. Each end section 62 includes a pair of depending longitudinally spaced and aligned tabs 67. The width of the tabs 67 is the same as the spacing of the faces of the vertical parts 43 of the baffle flanges 38 so that when inserted in the top of a baffle 14, they index or align the clip 60 and baffle. Holes 68 for self-tapping screws are located to overlie the horizontal parts 42 of the baffle flanges 40. The screws lock the clip 60 on a baffle oriented in the longitudinal direction of the clip 60. Slots 71 are cut out of the clip body at the transverse junction of each end section 62 and the center section 61. The clip is slightly offset along the line of the slots 71 so that the end sections 62 are slightly higher, for example, 1/32 inch, than the center section 61.

FIG. 8 illustrates an intersection between two baffles joined by the clip 60. The clip center section 61 overlies a "through" baffle 14 and an end section 62 overlies a cross baffle 14 abutting the through baffle. The clip 60 secures the baffles 14 together in abutting relation with screws driven through the holes 66, 68 into the underlying baffle flanges 38.

Where another cross baffle 14 is to be installed at the same location along the through baffle 14 in line with the illustrated baffle on the opposite side of the through baffle, it is secured with the clip in the manner described. Where only one cross baffle 14 is to be used at the same location, one of the end sections 62 is cut off at the slots 71. The slight elevation of a side section 62 above the center section 61 serves to hold a cross baffle 14 slightly higher than the through baffle 14. This avoids a gap at the bottom of the cross baffle which would otherwise occur if the baffle bottoms were at the same level due to the radius of the bend of the sheet material where the bottom and side of the through runner meet.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. In combination, an elongated baffle and a suspension clip, the baffle having a U-shaped cross-section including spaced vertically extending sidewalls, an upper edge of each sidewall having inwardly directed flanges, the flanges having a horizontal portion adjacent a respective said sidewall and a vertical portion spaced from the respective sidewall and depending from the horizontal portion, the suspension clip having an inverted U-shape body, including a horizontal web and depending flanges at opposite sides of the web, the flanges each having opposed ends and a slot at each end adjacent the web, each slot extending horizontally inwardly from an associated said flange end to a vertical slot, the vertical slot extending downwardly away from the web, the flanges of the baffle each being disposed in respective said horizontal and vertical slots of the clip, the web at each end of the clip overlying a respective flange of the baffle and confining the respective flange to the respective horizontal and vertical slots.

2. The combination of claim 1, wherein said depending clip flanges have aligned holes for supporting cables and wires.

3. The combination of claim 1, wherein said web has a central hole enabling the clip to be suspended by an element extending upwardly through said hole.

4. The combination of claim 3, wherein said clip is attached to one part of an assembly by a rivet through said central hole enabling motion about a first pivot axis, said assembly having another part pivoted relative to said one part about a second pivot axis perpendicular to said first pivot axis, said another part being pivotally connected to a grid tee engaging clip pivoted about a third pivot axis.

5. The combination of claim 3, wherein said clip is attached to a grid tee engaging clip by a rivet comprising said element.

6. The combination of claim 5, wherein said rivet is set to allow each of said clips to pivot relative to one another about a vertical axis.

7. The combination as set forth in claim 6, wherein said grid tee engaging clip is formed of sheet metal, said grid tee engaging clip having low profile tabs adapted to overlie a grid tee flange for support of said clips by said grid tee flange while allowing a ceiling panel to overlie said grid tee flange and one of said tabs at a level above the grid tee flange equal to a thickness of said sheet metal forming said grid tee engaging clip.

* * * * *